United States Patent [19]

Case et al.

[11] Patent Number: 4,849,090

[45] Date of Patent: Jul. 18, 1989

[54] BAG ROLL

[75] Inventors: Manson D. Case; Harry B. Wilfong, Jr.; William C. Hoffmeyer, all of Hartsville, S.C.

[73] Assignee: Sonoco Products Company, Hartsville, S.C.

[21] Appl. No.: 192,438

[22] Filed: May 11, 1988

[51] Int. Cl.[4] ..... B65D 69/00; B65D 85/671

[52] U.S. Cl. ..... 206/390; 53/443; 206/554; 383/37; 493/194; 493/264

[58] Field of Search ..... 53/443, 540, 544; 206/390, 494, 554; 383/37; 493/194, 198, 199, 263, 264

[56] References Cited

U.S. PATENT DOCUMENTS

| | | | |
|---|---|---|---|
| 3,001,646 | 9/1961 | Cooper | 206/390 |
| 3,049,228 | 8/1962 | Burnett | 206/390 |
| 3,160,273 | 12/1964 | Reuther et al. | 206/390 |
| 3,161,347 | 12/1964 | Hannon | 206/390 |
| 3,332,547 | 7/1967 | Rowe | 206/390 |
| 3,348,762 | 10/1967 | Kasinkas | 206/390 |
| 3,682,051 | 8/1972 | Sengewald . | |
| 3,749,237 | 7/1973 | Dorton . | |
| 3,979,050 | 9/1976 | Cilia | 206/390 |
| 4,453,649 | 6/1984 | Origuchi | 206/554 |
| 4,550,831 | 11/1985 | Whitford | 383/37 |
| 4,630,310 | 12/1986 | Winesett | 493/194 |

*Primary Examiner*—Jimmy G. Foster

*Attorney, Agent, or Firm*—Dennison, Meserole, Pollack & Scheiner

[57] ABSTRACT

A roll of flexible plastic film bags formed of a continuous strip of bags with transverse severance lines between the individual bags. The bags dispense in a forward direction from the roll with each following bag adhesively tacked to the roll with a resistance to release slightly greater than the resistance to release of the severance line for a stabilization of the roll as the leading bags are severed therefrom. The tack securing of each following bag is provided by the application of an adhesive to the inner face panel of each bag adjacent the mouth end thereof as the roll is being formed.

9 Claims, 2 Drawing Sheets

FIG. 1
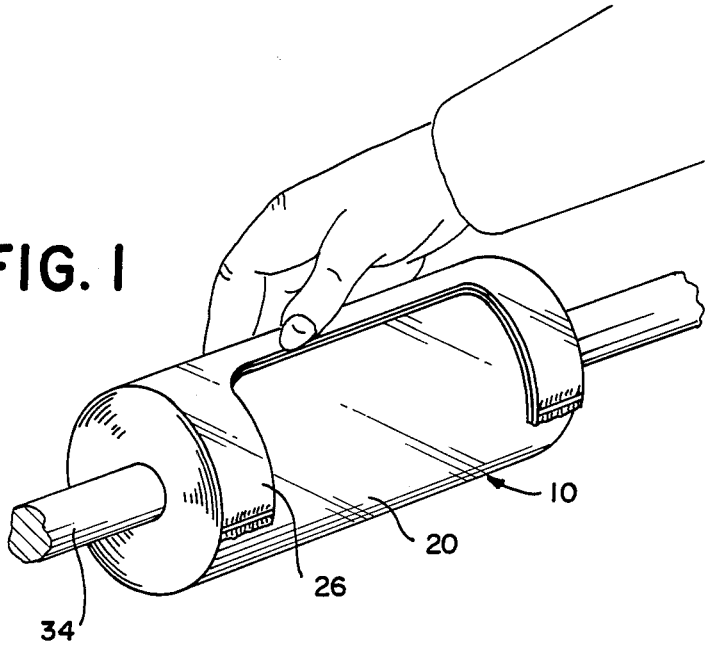
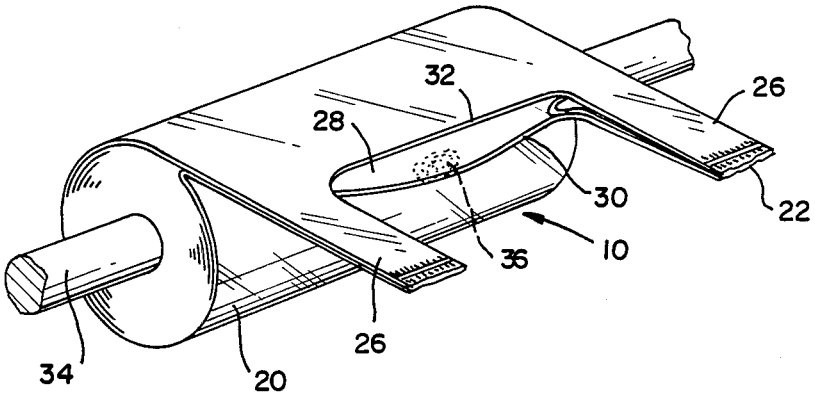
FIG. 2

BAG ROLL

BACKGROUND OF THE INVENTION

The invention is broadly concerned with rolls of plastic film bags, particularly handle or T-shirt bags formed in a continuous strip with transverse severance lines between the individual bags.

The formation of such bags in a continuous strip, and the supplying of the bags in rolls is considered particularly desirable and provides distinct advantages in the forming, shipping, storing and dispensing of the bags.

However, the provision of plastic film bags in rolls also gives rise to particular problems. Specifically, the dispensing of individual bags from rolls has conventionally required the use of two hands, one to sever the bag from the roll and the other to stabilize the roll. Further, and as is common with film bags, the actual opening of the individual bag is less than convenient because of the extremely thin nature of the bag material, static cling, and the like.

SUMMARY OF THE INVENTION

The present invention involves means and method for forming rolls of T-shirt bags or the like whereby individual bags can be removed from the roll, and simultaneously opened, with a single motion of one hand.

In providing for the dispensing of single bags from a roll of continuous bags and the opening of the bag by a single motion of one hand, the present invention achieves an operational efficiency far superior to the conventional system requiring two hands and a distinct manipulation to open the bag subsequent to removal from the roll. It is significant that in providing for access to the individual bags using only one hand, reliance is had solely on the construction of the roll, and has no bearing on the manner in which the roll is mounted, that is whether on spindles, horizontal shafts, or the like. In addition, the modification of the roll to accommodate the one-handed dispensing in accord with the invention is, while unique, a rather simple procedure involving minimal expense and minimal modification of conventional bag forming and rolling procedures.

More specifically, the invention involves a roll of flexible plastic film bags formed from a continuous strip of bags, preferably handle or T-shirt bags, joined along transverse severance lines which may be defined by perforations. The strip of bags can be formed in any conventional manner, for example from a continuous tube of plastic film selectively heat sealed, cut and perforated to define the joined individual bags. The bags include opposed face panels, joined along the opposed side edges either directly or through gusseted side walls. The bags, in the roll, are flat with the opposed face panels of each bag comprising an inner panel and an outer panel.

In accord with the present invention, the bags are rolled in a manner whereby, during dispensing, the bags are oriented with the mouths of the bags forwardmost or leading from the roll. The roll itself will mount on an appropriate spindle, support shaft or the like. As thus far described, the removal of an individual bag from the roll will require a pulling of the bag with one hand and a stabilizing of the roll with the second hand. After removal, the bag will require manipulation by both hands to open the bag mouth.

The problems of bag removal and opening are solved by the present invention through the unique expedient of providing a releasable adhesive or bonding between the outer surface of the inner panel of each bag, at least adjacent the mouth-defining edge thereof, and outer surface of the outer panel of the same or a following bag lying therebeneath in the roll. The outer panel of each bag is free of the inner panel of the same bag. The adhesive provides a bond which, while readily released during the forward pulling of the leading bag, is of a strength which requires a greater force to release than that required to sever the bag at the line of severance or perforations. In other words, as the leading bag is drawn from the roll, the adhesive bonding of the inner face panel of the following bag retains the following bag with sufficient resistance to allow the leading bag to sever from the following bag without simultaneously effecting a withdrawal of the following bag from the roll. This retention of the following bag until the leading bag is severed stabilizes the roll against rolling movement as the leading bag is dispensed, thus requiring the use of only a single hand to retrieve a bag.

As previously noted, it is also a significant object of the invention to open the bag simultaneously with the dispensing of the bag. The ability to do so is also a direct result of the adhesive bonding of the inner panel of each bag, particularly adjacent the bag mouth, while the outer panel of that bag is retained free of the corresponding inner panel. Thus, one need merely place one's hand over the outer face panel adjacent the mouth and slide the outer panel, through a manipulation of the fingers, relative to the tacked inner panel to provide for a separation of the edges and an easily grasped outer panel edge. Such a hand manipulation is effected in a single motion which continues, with the exposed edge grasped, in a forward motion drawing the bag from the roll and subsequently spreading the mouth of the bag until such time as the adhesively tacked inner panel of the leading bag pulls free from the underlying roll. At that point, the leading bag will move from the roll with the roll rotating until limited by the adhesively tacked inner face panel of the immediately following roll, at which point the leading bag will sever along the transverse line of perforations.

In the formation of a roll in accord with the invention, the bags will be formed and rolled following generally conventional procedures with the additional unique step of spraying, rolling or otherwise applying adhesive to the inner face panels of the bags immediately prior to introduction into the roll.

Additional features, objects and advantage of the invention may be noted as residing in the details of construction and manner of use as more fully hereinafter described.

BRIEF DESCRIPTION OF THE DRAWINGS

FIG. 1 is a perspective view of a roll of bags formed in accord with the present invention and illustrating the manner of initially grasping the leading bag for a withdrawal thereof;

FIG. 2 is a perspective view of a partially withdrawn leading bag illustrating the adhesive tacking of the inner face panel thereof;

DESCRIPTION OF PREFERRED EMBODIMENT

Figure 3:
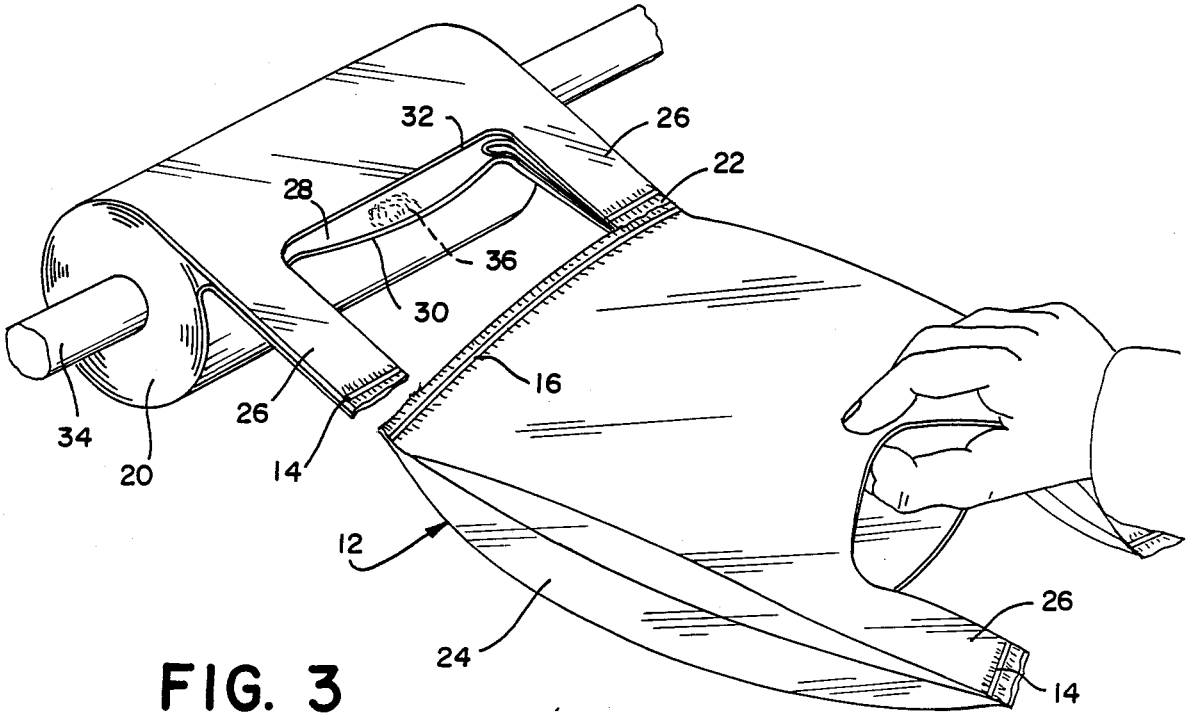
FIG. 3 is a view of the leading bag with the mouth thereof automatically opening and illustrating a partial severing from the following bag.

Referring now more specifically to the drawings, reference numeral 10 designates a roll of flexible plastic film bags 12 formed in accord with the present invention. The bags 12 are provided in a continuous strip, normally from an endless tube of appropriate film material, for example polyvinyl chloride, polyethylene, and the like. The individual bags are defined by top and bottom transverse seams 14 and 16 which may be formed by a thermoplastic welding of the opposed face panels 18 and 20 of the individual bags. A transverse severance line 22, for example a line of perforations, is provided between the bottom of each bag 12 and the top of the immediately following bag, between the adjacent bottom and top seams 16 and 14 of the respective adjacent bags. The individual bags are completed by U-shaped cutouts extending inwardly from the top edge of each bag centrally between the opposed side edges or walls 24 of the bag to form opposed handles 26 with the bag mouth 28 defined therebetween by overlying upper edges 30 and 32 of the respective face panels 18 and 20. As will be appreciated from the drawings, the mouth-defining cutout extends through the severance line between the corresponding bag and the bag forward thereof with the bags remaining severably joined at the leading ends of the handles 26.

Rolls of bags as above described will normally mount on shafts 34 or the like at the point of use whereat the individual bags are removed, opened and loaded with goods. Conventionally, the removal of the individual bags requires the use of two hands, one hand to grasp the leading bag and outwardly pull the bag, while the other hand is used to stabilize the roll and provide sufficient resistance for a severance of the leading bag from the following bag. Further, after the bag has been removed, a two-handed manipulation is involved in opening the bag. While it is conceivable that mechanical means, associated with the roll mounting structure or external thereof, can be provided for sufficiently retarding the following bag to allow for severance of the leading bag, it is the primary object of the present invention to provide such means as an integral portion of each roll.

Figure 4:
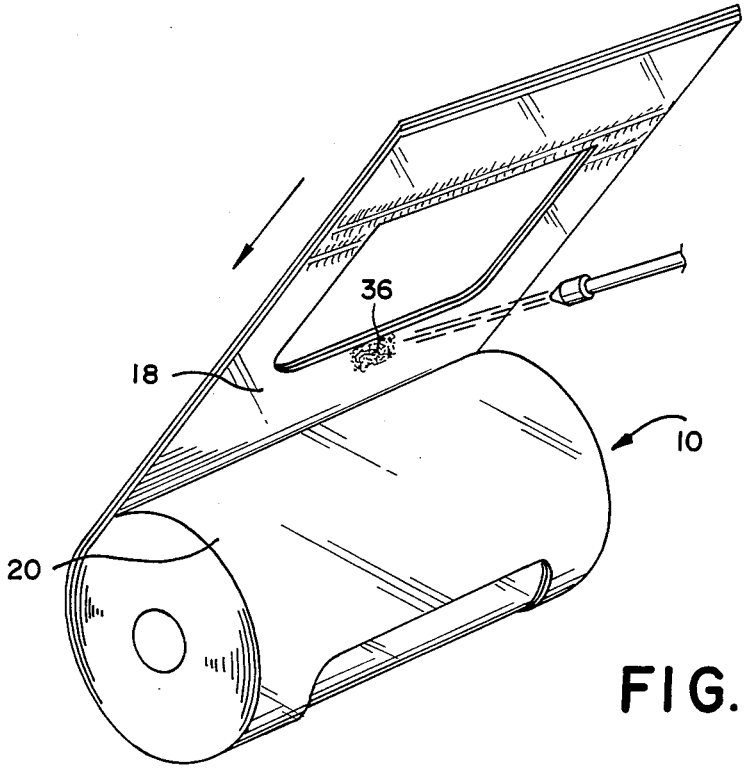
FIG. 4 is a perspective illustration schematically presenting the application of the bonding or tacking adhesive as the roll is formed.

Noting FIG. 4 in particular, the invention herein involves the unique expedient of providing an adhesive 36, sprayed as illustrated, rolled or applied in any other appropriate manner to the bottom face panel 18 of each bag 12 as the continuous strip of bags is rolled to define the bag roll 10. This adhesive 36 is applied at least immediately adjacent the mouth-defining edge 30 of each panel 18, and may as a matter of manufacturing convenience, be applied along the full length of the individual bags 12, or at least a major portion thereof commencing adjacent the leading edge 30.

The applied adhesive provides for a releasable adhering or bonding of the inner panel 18 of each bag to the outer panel or panel portions inward thereof in the formed roll 10. The releasable adhesive bonding, while allowing for a withdrawal of a leading bag from the roll, has a resistance to release between the bags which is greater than the resistance to severance inherent in the severance line or line of perforations 22. Thus, and as suggested in FIG. 3, while the leading bag can be withdrawn from the roll with the handles 26 of the following bag moving off of the roll therewith, the adhesive 36 on the inner panel 30 of the following bag provides a sufficient resistance to a continued unrolling of the bags whereby a severance of the leading bag from the following bag along the severance line 22 will occur. It will be appreciated that this resistance to unrolling of the following bag by the releasable adhesive bond 36 actually stabilizes the roll 10 until such time as the leading bag is torn from the roll, thus avoiding the necessity of using one's hand to fix the position of the roll during the severing operation. As can be appreciated, the resistance to release of both the adhesive bond and the severance line can be varied in many ways, including the provision of greater or smaller perforations or varying the tacking strength of the adhesive itself, or any combination thereof. Thus formed, the present invention uniquely provides for removal of individual plastic film bags from rolls utilizing only a single hand.

It is also a significant object of the invention to provide for the opening of the bag during the removal of the bag from the roll as a part of the same one-handed motion. This is effected by the specific provision of the adhesive solely between the outer surface of the inner panel of each bag and the outer surface of the underlying outer panel, whether of the same bag or of the following bag depending on the thickness of the roll. The outer panel of each bag remains free of its associated inner panel at and inward of the mouth edges 30 and 32 between the respective inner surfaces. That is, there is no adhesive bonding between these edges and the inner surfaces of the panels of the same bag. Thus, and noting FIGS. 1 and 3 in particular, one need merely position one's hand over the leading edge portion of the outer panel of the leading bag 12 and slide this outer panel relative to the adhesively secured associated inner panel to allow for a finger grasping of the leading edge portion of the outer panel adjacent the mouth-defining edge 32. Once grasped, the bag is forwardly drawn with the mouth automatically opening in light of the adhesively retained inner panel 18 adjacent the mouth edge 30 thereof. The mouth of the leading bag will substantially fully open prior to a release of the associated inner panel 18 adjacent the leading or mouth-defining edge 30 thereof. It is to be recognized that the single-handed manipulation of the bag can involve a single continuous movement from the point of initial engagement of the hand with the outer panel at the leading edge thereof to the actual severing of the bag from the following bag with the mouth thereof substantially fully open. The advantages to being able to dispense and open plastic film bags in this manner will be readily apparent to anyone familiar with the difficulties in handling such bags due to the extremely thin and highly flexible nature thereof and the resultant problems of static cling and other forms of film adherence developed between the panels of the individual bags during manufacture.

We claim:

1. A roll of flexible plastic film bags formed in a continuous strip, each of said bags having opposed face panels, an open mouth end and a closed bottom, the mouth ends of the bags, in the roll, being forwardmost for grasping and forward withdrawal from the roll, readily severable means releasably joining the bottom of each bag to the mouth end of an immediately following bag along a transverse severance line, the face panels of each bag in the roll comprising an inner panel and an outer panel with said inner and outer panels, at the mouth end of the bag, having free overlying edges defining a bag mouth, and tack means adjacent the free edge of the inner panel of each bag releasably securing the inner panel to an outer panel aligned inward thereof on the roll, the tack means providing a greater resistance to release than said severable means whereby an outwardly drawn leading bag on said roll will release from the immediately following bag along the severance line therebetween prior to release of the tack means securing the inner panel of the following bag.

2. The roll of claim 1 wherein said tack means comprises an adhesive.

3. The roll of claim 2 wherein each bag therein, at the mouth end, includes laterally spaced forwardly directed handles with the bag mouth defined therebetween.

4. In a roll of flexible plastic film T-shirt bags formed in a continuous strip with transverse severance lines between adjacent bags, said bags being removable from said roll in a forward direction, each bag including forwardly directed handles with a transverse bag mouth therebetween, each said bag mouth being defined by bag panels comprising inner and outer panels relative to the roll; releasable retaining means engaged between each bag and the roll for retaining the bag to the roll until the bag forward thereof is separated along the severance line between the two bags, said retaining means engaging between the inner panel of each bag, adjacent the mouth, and the underlying roll.

5. The roll of claim 4 wherein said retaining means comprises an adhesive bond.

6. In a roll of flexible bags formed in a continuous strip with transverse severance lines between adjacent bags, said bags being sequentially removable from said roll in a forward direction, releasable retaining means engaged between each bag and the roll for retaining the bag to the roll until the bag forward thereof is separated along the severance line between the two bags, said retaining means providing a greater resistance to release then said severance lines whereby an outwardly drawn forward bag on said roll will release from the immediately following bag along the severance line therebetween prior to release of the retaining means retaining the following bag.

7. The roll of claim 6 wherein each bag comprises inner and outer panels relative to the roll, said retaining means engaging between the inner panel of each bag and the underlying roll.

8. The roll of claim 7 wherein said retaining means comprises an adhesive bond.

9. In a method of forming a roll of bags from a continuous strip of bags releasably joined along transverse severance lines for forward withdrawal of the individual bags from the roll and the severance of each forwardmost bag from the immediately following bag; the steps of rolling said strip of bags into a roll and applying a releasable tacking means of greater resistance to severance than said severance lines between each bag and the previously rolled bags as the roll is being formed.

* * * * *